US006006642A

United States Patent [19]

Granger

[11] Patent Number: 6,006,642

[45] Date of Patent: Dec. 28, 1999

[54] DISPENSING MACHINE FOR STRIPS OF COILED WADDING MATERIAL USING AUTOMATIC OR SEMI-AUTOMATIC TRACTION WITH SPARE ROLL

[76] Inventor: Maurice Granger, Saint Preist en Jarez, France

[21] Appl. No.: 08/983,228

[22] PCT Filed: Jun. 17, 1996

[86] PCT No.: PCT/FR96/00925

§ 371 Date: Jan. 12, 1998

§ 102(e) Date: Jan. 12, 1998

[87] PCT Pub. No.: WO97/02780

PCT Pub. Date: Jan. 30, 1997

[30] Foreign Application Priority Data

Jul. 13, 1995 [FR] France ..... 95.08923

[51] Int. Cl.[6] ..... B26D 7/00

[52] U.S. Cl. ..... 83/649; 83/650

[58] Field of Search ..... 225/93; 83/649, 83/650; 242/55.3, 68.5

[56] References Cited

U.S. PATENT DOCUMENTS

| | | | |
|---|---|---|---|
| 3,160,047 | 12/1964 | Malloy et al. | 83/650 |
| 3,183,752 | 5/1965 | Mews | 83/650 |
| 4,427,144 | 1/1984 | Macgrory et al. | 83/650 |
| 4,432,261 | 2/1984 | DeLuca | 83/650 |
| 4,844,361 | 7/1989 | Granger | 242/55.3 |

*Primary Examiner*—M. Rachuba
*Attorney, Agent, or Firm*—Wall Marjama Bilinski & Burr

[57] ABSTRACT

A twin-roll paper dispensing machine for dispensing coiled wadding paper includes a housing having a protective cover, the housing being defined by lateral sides spaced to accommodate a spare roll in an upper part, a service roll in a middle part and a cutting device and pressure component adjacent a drum in a lower part thereof. The pressure component presses against the drum between which a strip of paper to be cut is inserted. The middle and lower parts of the housing are separated by a profiled plate which ensures removal of a used service roll. The device further includes a hinged flap on each side to allow clearance for the spare roll, an articulated swinging link which accommodates elastically mounted tabs arranged to receive and hold the service roll on at least one side and, a pair of small plates articulated from the sides to retain the spare roll in the middle part of the housing. A lever assembly is linked to the flap, the elastic tabs and the small plates which enables measurement of the diameter of the service roll at a certain point of dispensing. The lever assembly also transfers the spare roll from the upper part of the middle part to replace the used service roll.

15 Claims, 9 Drawing Sheets

3
B
3a
9
11
3d
RR
13
12
15
18
14b
3c
27
17
27a
21
21a
14
35
20
29
30a
RS
28
23
B
33

DISPENSING MACHINE FOR STRIPS OF COILED WADDING MATERIAL USING AUTOMATIC OR SEMI-AUTOMATIC TRACTION WITH SPARE ROLL

BACKGROUND OF THE INVENTION

The invention relates to the technical field of machines for dispensing and cutting strips of coiled material made of wadding or other material in order to ensure the dispensing of paper hand-wipes, general-purpose paper wipes, napkins, handkerchiefs and other articles. In particular, the invention relates to twin-roll dispensing machines, i.e. a machine that includes a first dispensing roll that is being unreeled and a spare roll that can be transferred to replace the former when the first roll is exhausted or nearly exhausted.

The Applicant has already developed such twin-roll machines, especially in French Patent. In this type of twin-roll machine, the reels of material have end fittings that are inserted into the reel holder, said end fittings being designed with a protruding stub capable of being used as a means to guide the reels along vertical slide rails formed on the body of the lateral sides of the machine as shown in U.S. Pat. No. 2,364,838. According to U.S. Pat. No. 2,599,726, the stubs are gripped by an articulated connecting-rod transfer mechanism capable of allowing the spare roll to be fitted instead of the roll that is nearly completely unwound.

With this technique, the reels of material include the reel holders and associated end fitting which permit and facilitate the actual transfer operation.

However, it appears that a very large number of reels of material do not have any end fitting and, as a result, as far as the Applicant is aware, there is no twin-roll machine for these types of reels. The difficulty is the ability to control a very large number of parameters including, in particular, the weight of the spare reel which, as it drops down into the bottom of the machine, is likely to exert a relatively large force. Consequently, this force must be controlled if one wishes to prevent the machine from being damaged at an early stage.

SUMMARY OF THE INVENTION

The object sought after by the invention is therefore to design a twin-roll dispensing machine for strips of paper that includes a spare roll where the reels do not have any end fitting and which ensures reliable, prolonged operation without damage to the various components thanks to complete control of the operation of transferring the spare roll into position to replace the roll that is in use e.g. a (service roll).

Another object sought after by the invention is to design a machine that can be adapted to dispense any type of reel of paper.

Another object sought after is for the machine to be capable of operating with both automatic and semi-automatic cutting.

Another object sought after by the invention is to produce a machine which, despite its complex operation, is straightforward and inexpensive to produce and is of a design which allowed its various components to be assembled without using any special tool.

Another object sought after by the invention is to produce removable lateral sides which made it possible to manufacture the various components of the machine by moulding them and allowed their quick assembly.

According to a first aspect of the invention, the dispensing machine for strips of called wadding paper using automatic or semi-automatic traction of the twin-roll type including a service roll and a spare roll comprising, in a housing accommodating a protective cover, lateral sides devised to accommodate, in the upper part, the spare roll, in the middle part, the service roll and in the lower part, a drum associated with a cutting device and a pressure component that presses against the drum and between which the strip of paper to be cut is inserted, and is distinctive in that the sides are devised in the form of flat plates and are arranged from the top towards the bottom with a first upper area to accommodate the spare roll, a middle area to retain the service roll and a lower area to accommodate the drum and associated cutting device, the separation between these areas being obtained by a separately mounted profiled plate that ensures removal of the service roll when it is used up, the sides being designed with the following on the two sides:

- a first means providing clearance for service rolls at the start of the cycle, then spare rolls,
- a third means that ensures retention of the spare roll, and on at least one of the sides:

- a second means that ensures retention of the service roll,
- a fourth means that cooperates with the first, second and third means to enable, depending how much of the service roll has been dispensed, measurement of the diameter of the latter and transfer of the spare roll into position to replace the service roll and removal of the exhausted service roll, the sides being designed with shaped openings in their thickness that are necessary for the operation of the machine and for clearance and articulation of certain of said means.

According to a second aspect of the invention, the dispensing machine is distinctive in that the lateral sides successively accommodate, from the top towards the bottom, the following means to ensure retention of the service and spare rolls and transfer of the spare roll from a storage position into a dispensing position:

- a first means in the form of a hinged flap providing clearance for the spare roll,
- a second means in the form of a swinging link that is articulated relative to the sides and accommodates elastically mounted tabs arranged to receive and hold the service roll as it is being dispensed, on at least one of the sides:

- a third means in the form of small plates articulated relative to the sides which ensures retention of the spare roll,
- a fourth articulated means devised to cooperate with said flap of the first means, said tabs of the second means and said small plate of the third means in order to enable, depending how much of the service roll has been dispensed, measurement of the diameter of the latter and transfer of the spare roll into position to replace the service roll, the sides being designed with shaped openings in their thickness that are necessary for the operation of the machine and for clearance and articulation of certain of said means.

These objects and others will become apparent from the following description.

BRIEF DESCRIPTION OF THE DRAWINGS

The object of the present invention is described, merely by way of example, in the accompanying drawings in which.

DETAILED DESCRIPTION OF THE INVENTION

Figure 1:
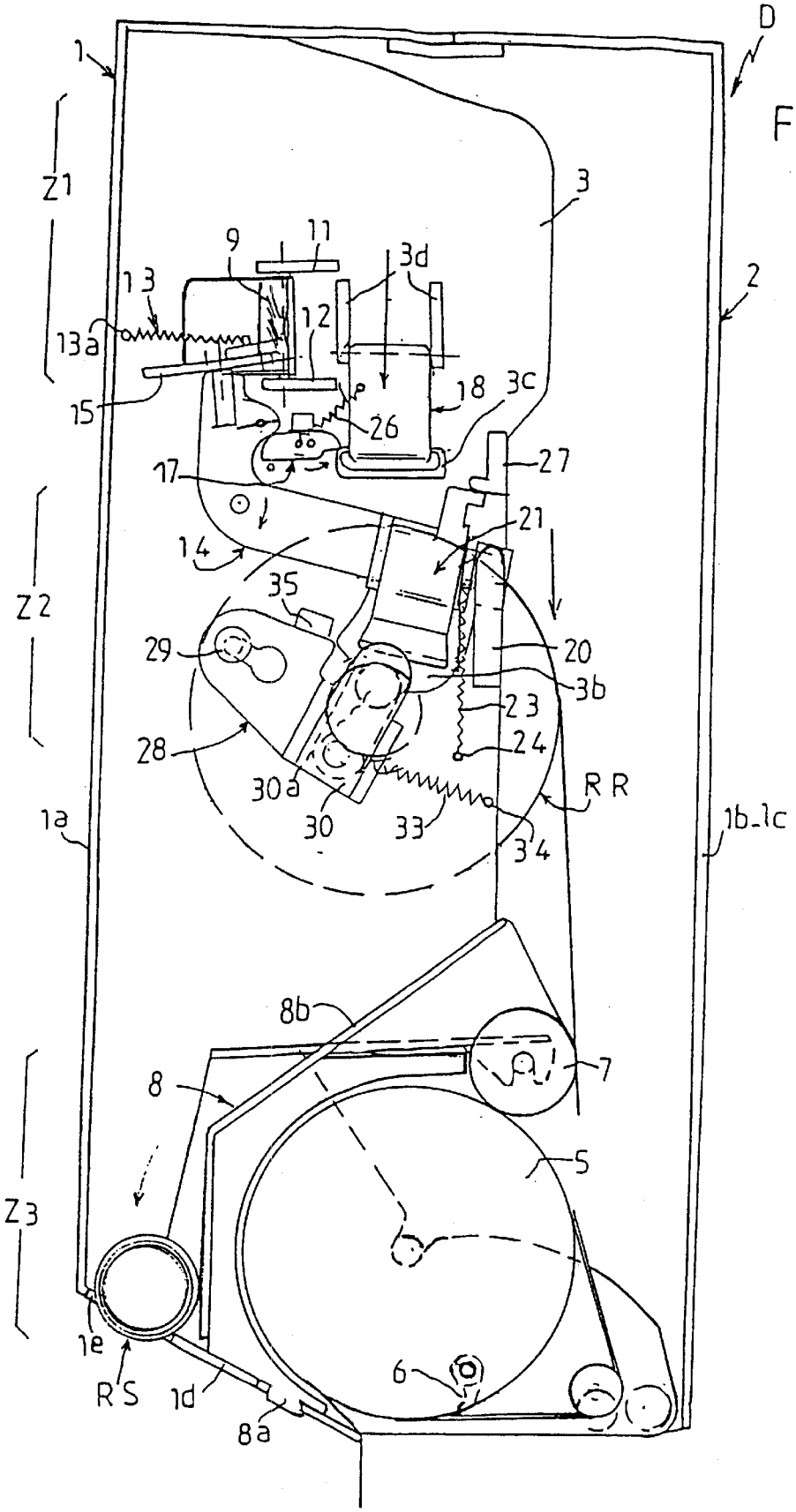
FIG. 1 is a sectional profile view showing a twin-roll dispensing machine, showing the locking side in the position where the spare roll drops and the service roll moves away.
Figure 2:
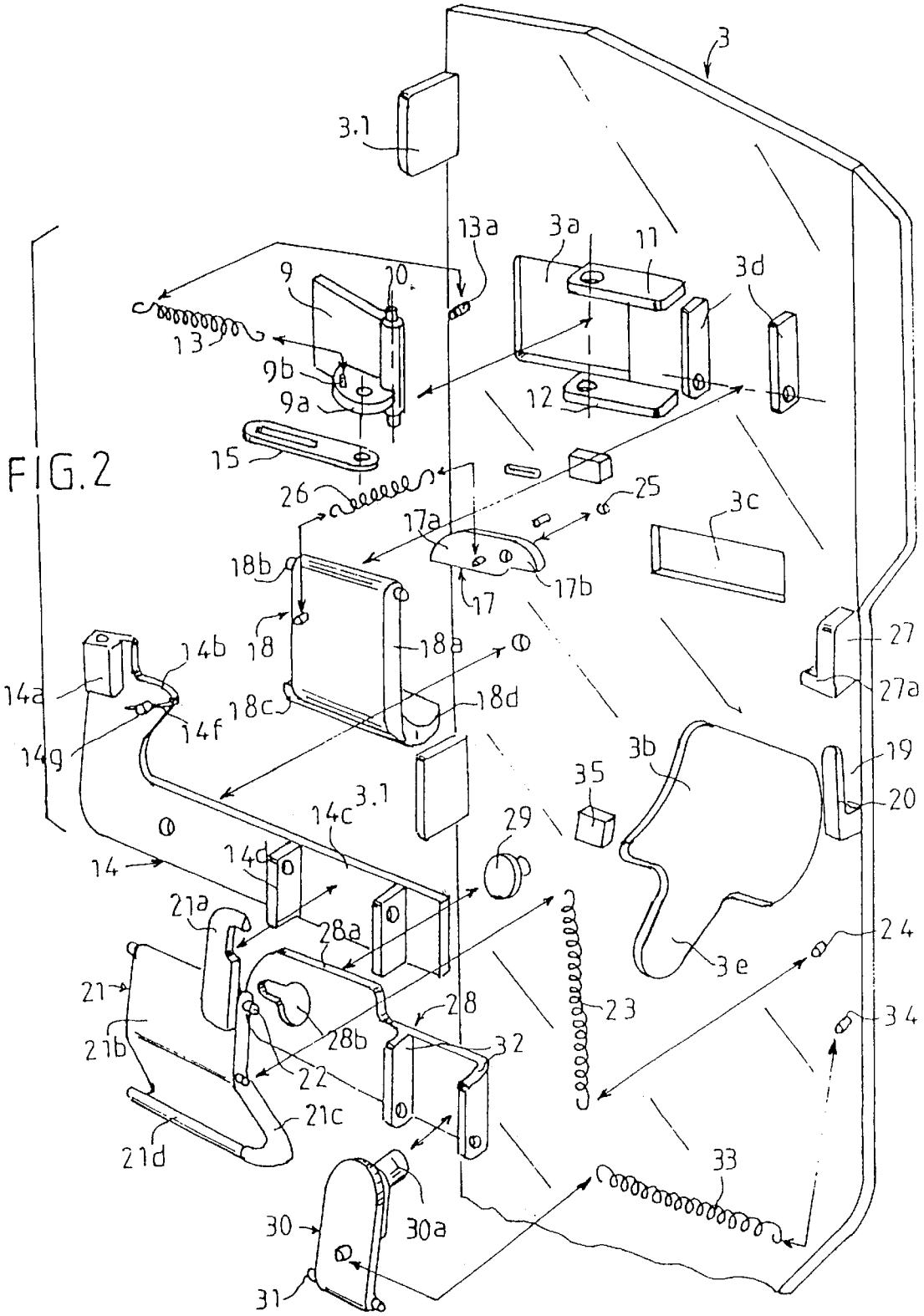
FIG. 2 is a perspective view, before assembly, of a first side of the machine including the various mechanisms to position the spare roll, position the service roll and transfer from the spare position to the service position.
Figure 3:
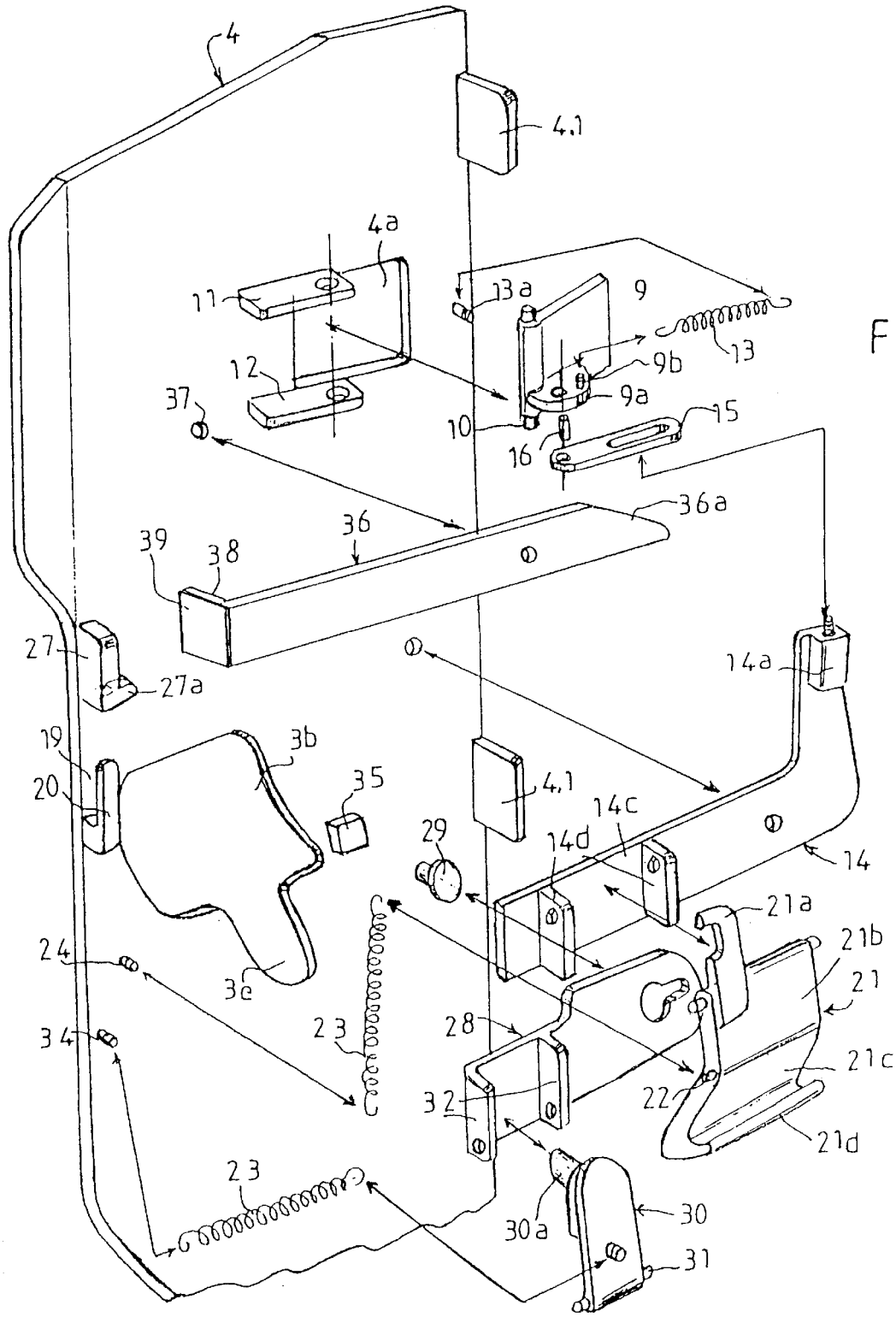
FIG. 3 is a perspective view, before assembly, of the second side of the machine including identical and matching means for the operation of the machine.
Figure 4:
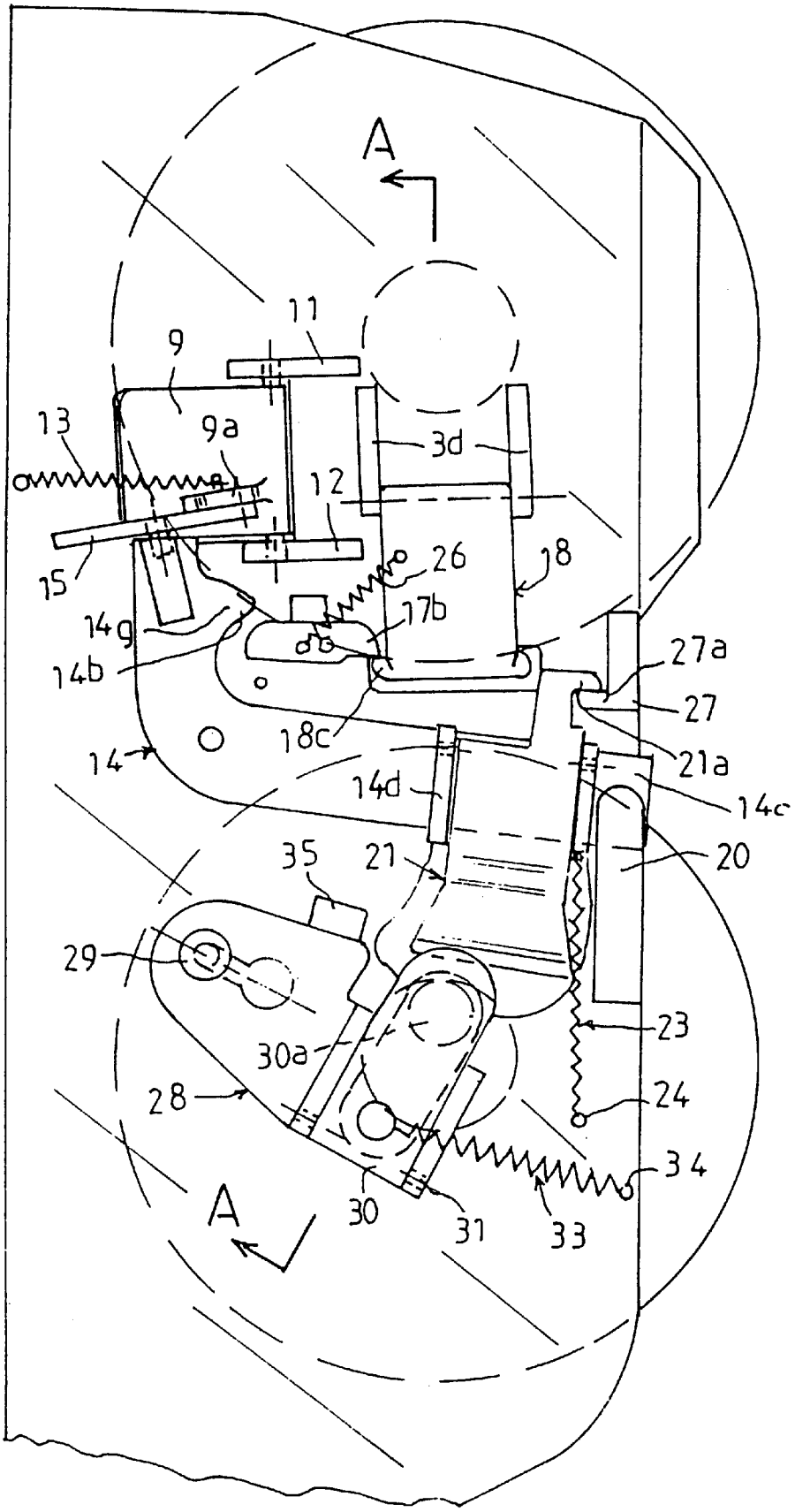
FIG. 4 is an enlarged scale partial profile view, same side as in FIG. 1, showing how the machine is loaded with a service roll and a spare roll.
Figure 5:
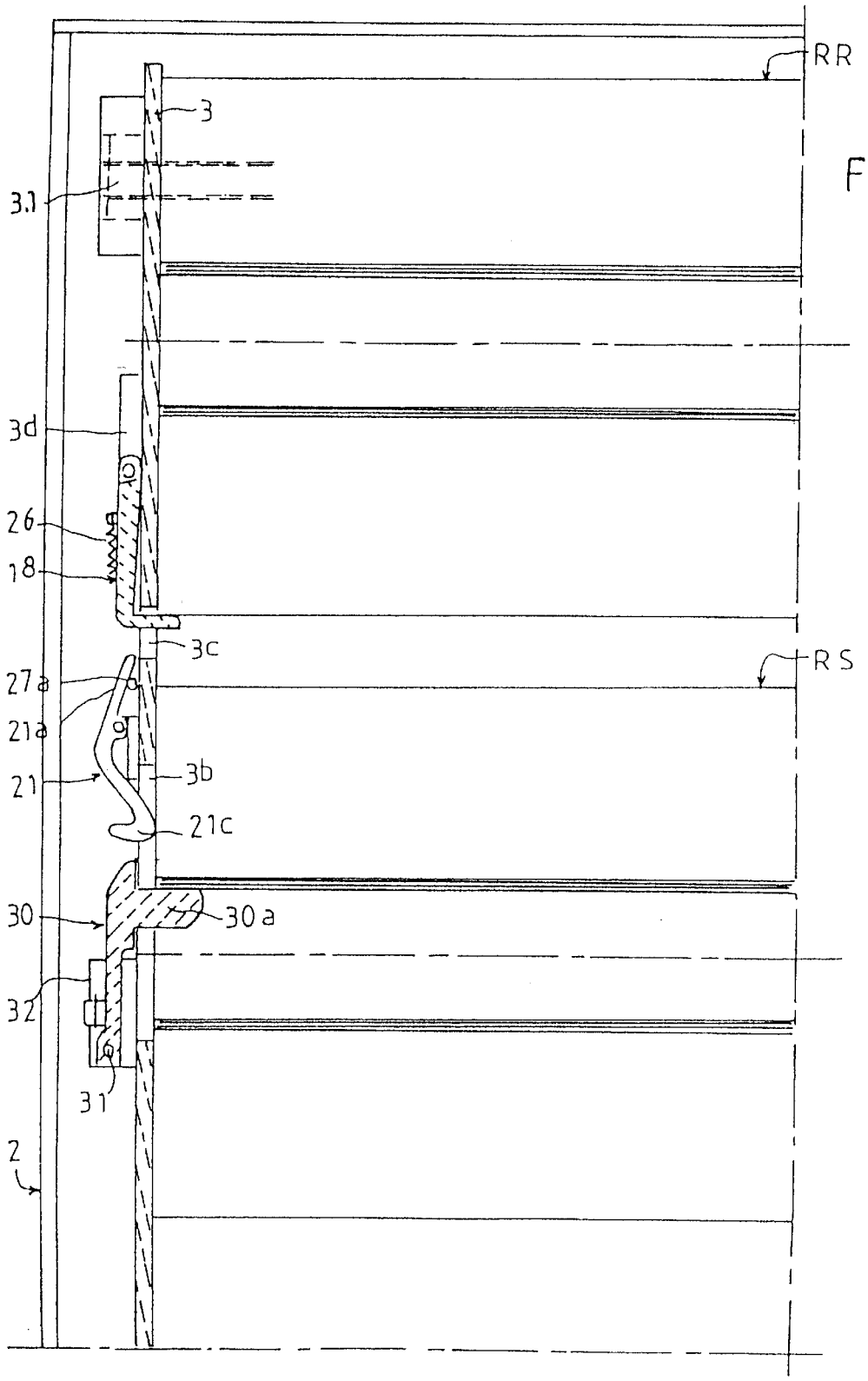
FIG. 5 is a partial front view along line A.A in FIG. 4 showing the position of the various mechanisms.
Figure 6:
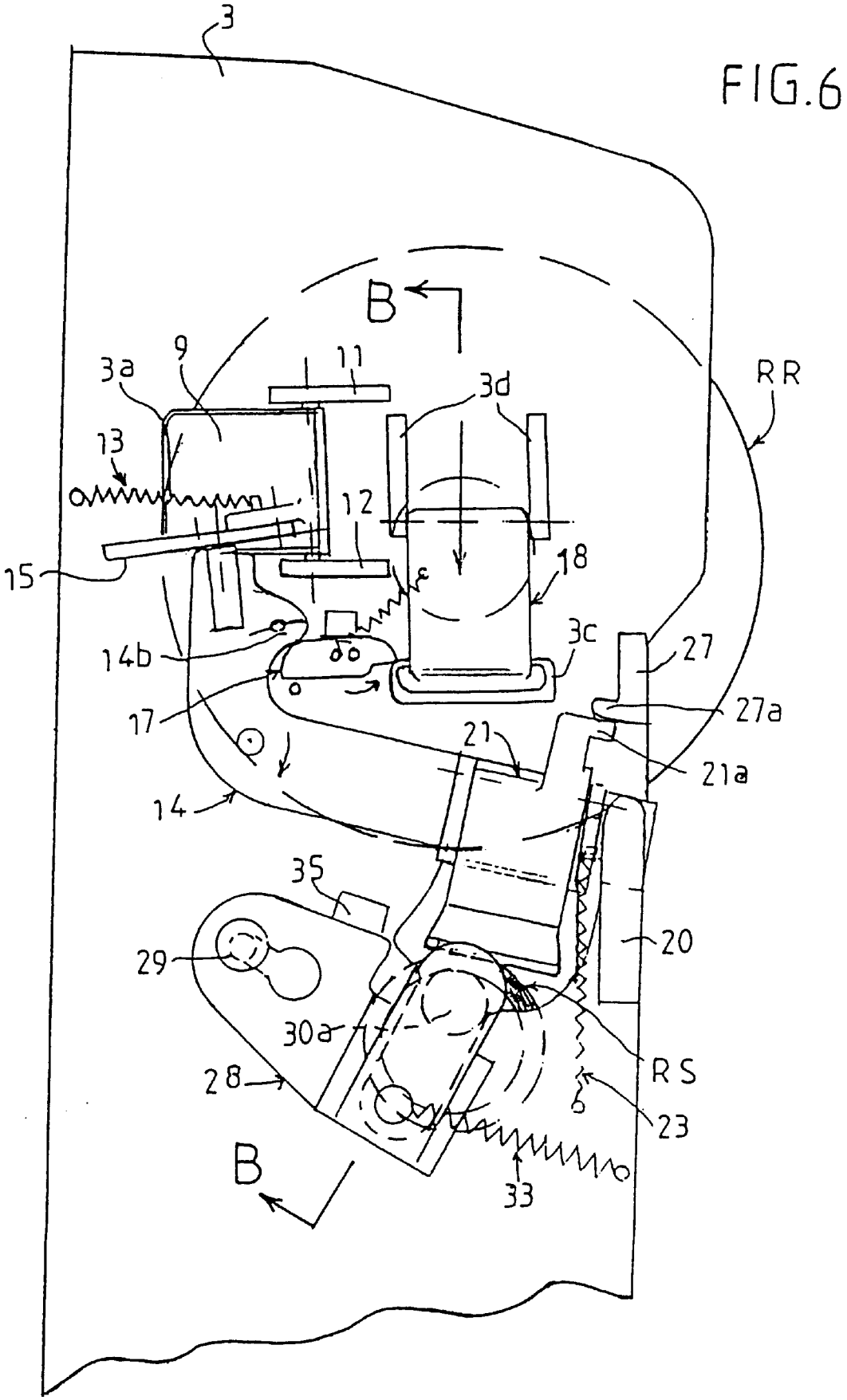
FIG. 6 is an enlarged scale partial view that details FIG. 4 corresponding to the phase in which the service roll is ready to be removed.
Figure 7:
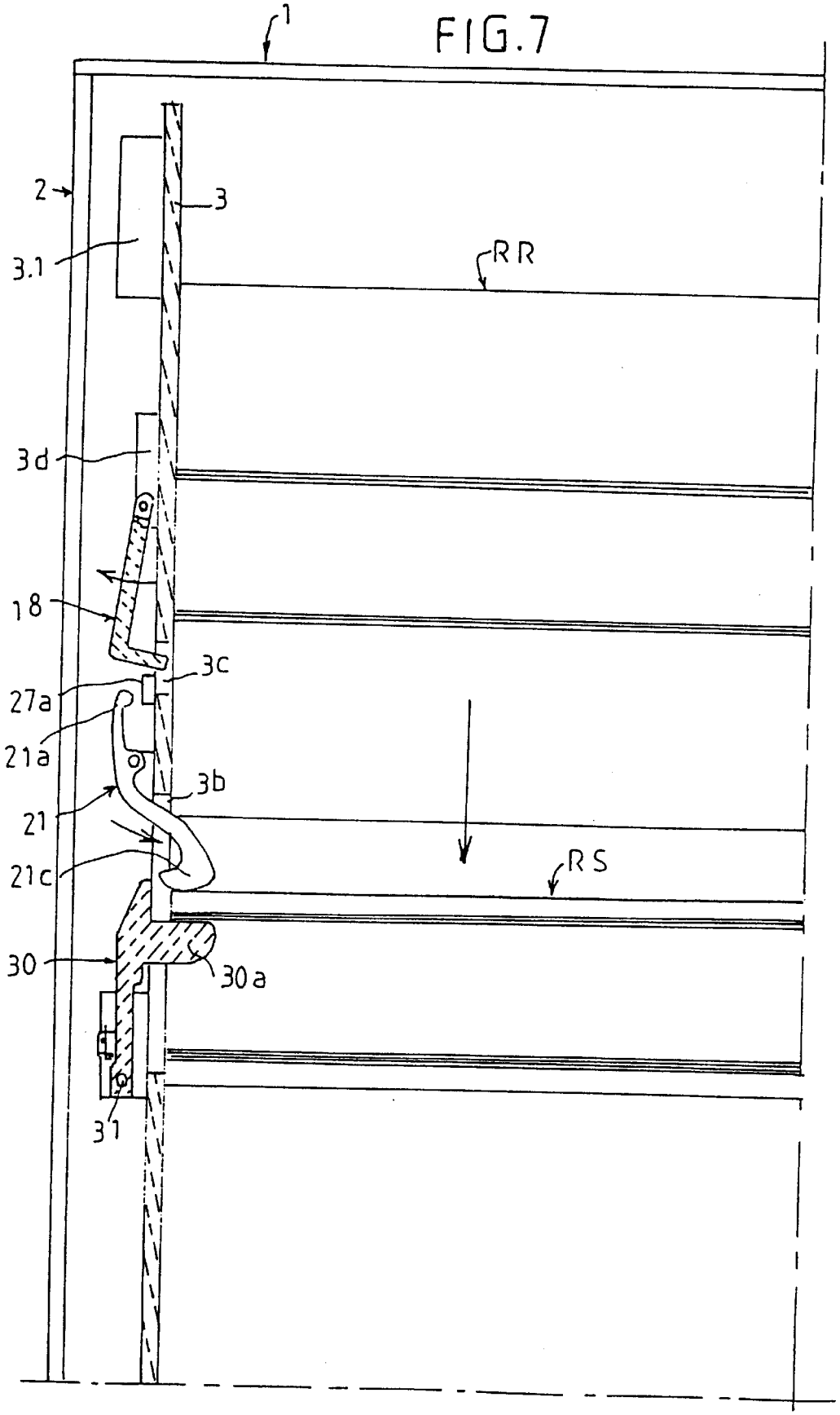
FIG. 7 is a front view according to FIG. 6 along line B.B.
Figure 8:
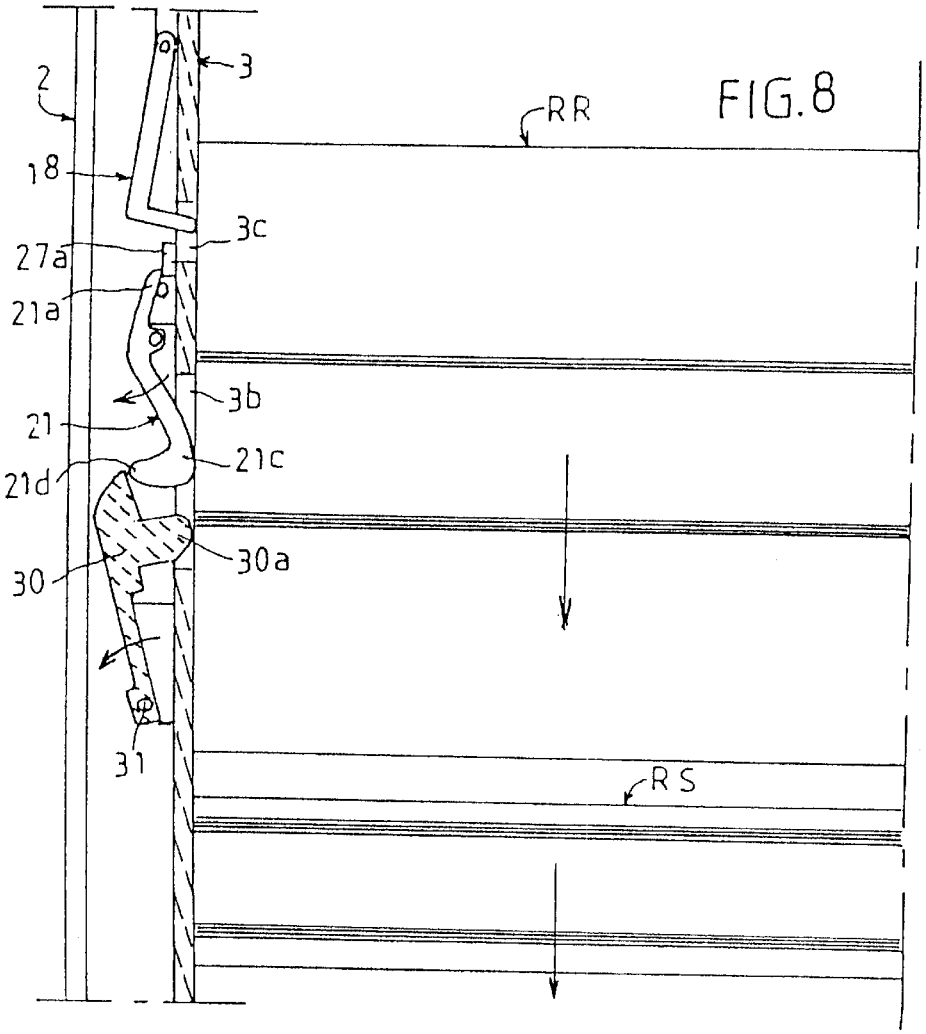
FIG. 8 is a partial front view showing the position of the mechanisms when the service roll moves away and during the final downward movement of the spare roll.
Figure 9:
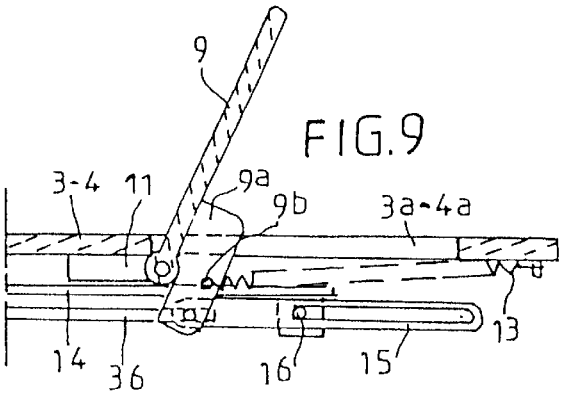
FIG. 9 is a partial sectional view showing a flap in the open position, i.e. with no spare roll.
Figure 10:
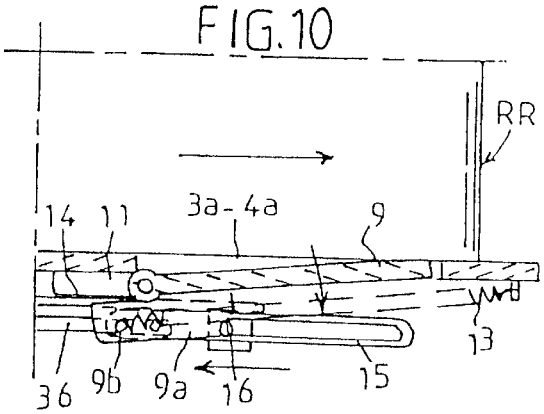
FIG. 10 is a view similar to FIG. 9 showing the flap closed, i.e. pushed back by introducing a spare roll.
Figure 11:
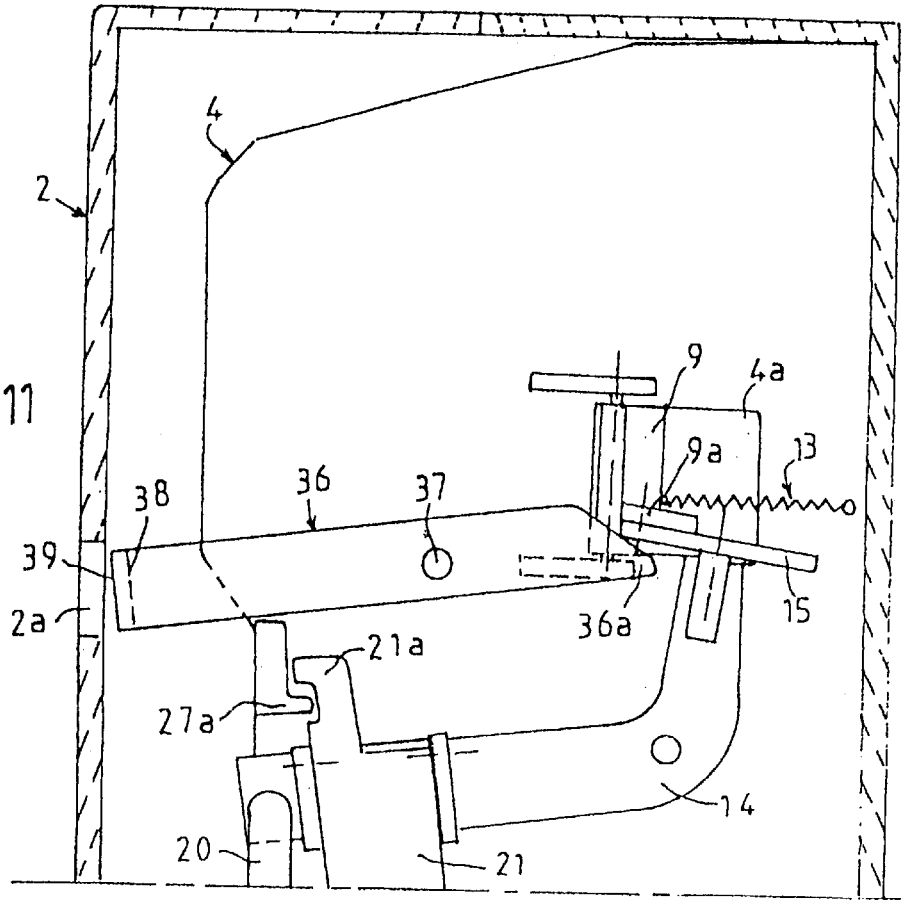
FIG. 11 is a partial front view corresponding to FIG. 9 showing the spare roll presence indicator lowered opposite the display window.
Figure 12:
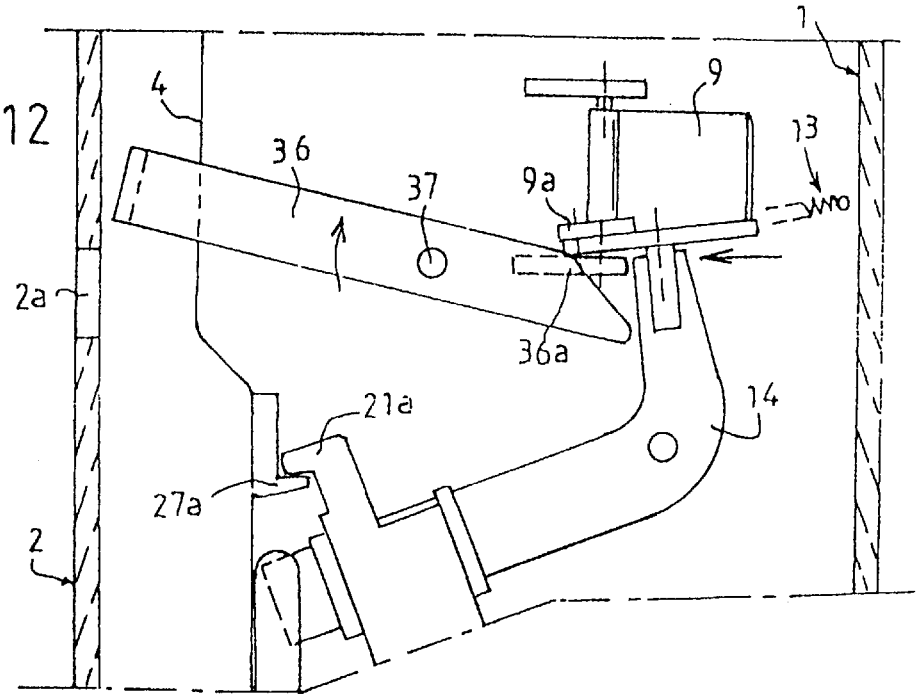
FIG. 12 is a view similar to FIG. 11, after loading the spare roll, with the flap therefore being closed and the loading indicator raised so that it is not visible through the window.

In order that the present invention may more readily be understood, the following description is given, merely by way of example, reference being made to the accompanying drawings.

The twin-roll dispensing machine is referred to in its entirety as (D) and comprises a tall housing (1) comprising a rear wall (1*a*), two vertical side walls (1*b*–1*c*) and a bottom wall (1*d*) designed with an outlet opening (1*e*) for the reel holder of the exhausted service roll (RS). A hinged cover (2) ensures protection of the assembly with known means of closing and locking.

The housing (1) is capable of accommodating, sideways and facing its walls (1*b*–1*c*), two lateral sides (3–4) devised in the form of flat plates that support the various mechanisms and components involved in the operation of the machine. These sides are made of the polycarbonate or other type of material and have, along their back edge, click-in tabs (3.1–4.1) for fixing them to the cover.

The two laterial sides (3–4) are designed, from the top towards the bottom, with three main areas, namely a first upper area (Z1) for receiving the spare roll (RR), a middle area (Z2) for holding the service roll and a lower area (Z3) capable of accommodating, in a known manner, a drum (5) associated with a cutting device (6) and a pressure component (7) that presses against the drum. The lower area (Z3) may be designed with the features described in the previous patents developed by the Applicant. These features will not be described in detail here because they do not directly concern the present invention.

Separation between the middle area (Z2) and the lower area (Z3) is, in particular, obtained by a V-shaped separately mounted plate (8) attached to the housing and the lateral sides by any known means, such as tabs 8(*a*), the upper part of this profiled plate having an oblique shape (8*b*) of which the purpose will be stated below.

As previously indicated, the upper and lower areas (Z1–Z2) accommodate means of supporting the spare and service rolls, as well as the mechanism for transfer from a standby position (spare roll) to a utilisation and dispensing position (service roll).

The lateral sides (3–4) successively accommodate, from the top towards the bottom and in order to ensure retention of the service roll and spare roll and transfer of the spare roll from a storage position into a dispensing position, the following:

a hinged flap (9) to provide clearance for the spare roll, a swinging link (28) that is articulated relative to the sides and accommodates elastically mounted tabs (30) devised to accommodate and hold the service roll during dispensing, on at least one lateral side (3), small plates (18) articulated with relative to sides (3–4) which ensure retention of the spare roll, and a check (21) devised to cooperate said flap (9), said tabs (30) and said small plate (18) in order to allow, depending how much of the service roll has been dispensed, measurement of the diameter of the latter and transfer of the spare roll into position to replace the service roll, the thickness of the sides being designed with shaped openings necessary for the operation of the machine and for clearance and articulation of certain of the flap (9), the swinging link (28), the tab (30), the plates (18) and the cheek (21).

Each of the above means will now be described. The upper part of laterial sides (3–4) corresponding to zone the upper (Z1) are each designed with a hinged flap (9) that protrudes inside the sides (3–4). This flap is vertically hinged on a pin (10) that is freely mounted relative to two first horizontal projections (11–12) formed on the outside of the side (3–4). This flap (9) is capable of being pushed backwards when the spare roll is fitted in position. Said flap has a protruding horizontal spur (9*a*) that has an anchoring pin (9*b*) for engaging the end of a first spring (13) the other end of which is attached in the back part of the side (3–4) to an anchoring point (13*a*). When the flap is not pushed back, it therefore projects beyond sides (3–4), this corresponding to the absence of a spare roll and above-mentioned spring (13) is not extended. A window (3*a*–4*a*) is formed in each lateral side (3–4) to allow retraction of said flap (9) when the latter is pushed back when a roll of material is put in.

The movement of the lower part of said flap (9) is associated with a bent lever (14) the middle part of which is hinged on above-mentioned side. Said lever is located in the intermediate part between the upper and middle areas (Z1) and (Z2) and fulfills, thanks to its highly special arrangement, a certain number of functions that will become apparent later on in this description.

The upper part (14*a*) of the bent lever accommodates a small connecting bar (15) which is joined to the above-mentioned flap (9) using a swivel pin (16) that links to the horizontal spur (9*a*). The forward part of the end of lever (14) forms a tip (14*b*) in order to cooperate with a shaped bolt (17) forming a cam, this bolt being articulated and cooperating with a small shaped plate (18) that holds the spare roll in position. The tip part (14*b*) has, in the centre of a saw cut, a tapped hole (14*f*) for screwing in a countersunk head screw (14*g*) through a slot (3*f*) in the housing intended for adjusting the position of the limit stop for the tip against the bolt, i.e. adjustment of the unfastening of the spare roll depending on the number of lengths to be pulled from the service roll that is nearly exhausted. The longer leg of said lever (14*c*) extends alongside said side (3). The end part of the leg of said lever is capable of being guided in a slit (19) formed between the wall of the side (3) and a tab (20) parallel to the latter, this tab being separately mounted and attached by any appropriate means. Adjacent the end of the leg of the lever (14) is a check (21) which hinges and swivels relative to the lever and is maintained by two axial protrusions (14*d*) that are an integral part of the projections (14*e*) formed on the lever. The upper part of this cheek (21) forms a hook (21*a*) whereas the general shape of the cheek is substantially S-shaped (21*b*).

The lower part of the check (21) forms a projection (21*c*) capable of protruding relative to side (3). Curved lower end (21*d*) is capable of forming a bearing and thrust plane. Part (21*c*) facing the service roll is capable of constituting a support and braking plane during downward movement of the service roll and/or spare roll. The cheek (21) is devised with a pin (22) for anchoring a spring (23) of which the other end is attached on the side to an anchoring point (24) in a subjacent plane. The spring (23) is not loaded when it is extended and downward movement of lever (14) causes retraction of spring (23). Side (3) has a wide cutout (3*b*) or window to allow clearance for and swivelling of the cheek.

Bolt (17) forming a cam is articulated relative to a pin (25) substantially placed in its middle part and joined to the above-mentioned lateral side (3). The back part of said bolt has a shape (17*a*) forming a ramp to cooperate with the upper part forming a tip (14*b*) of the bent lever (14). The front part of bolt (17*b*) forms a hook to cooperate with a small retention plate (18) for the spare roll. The small plate has a vertical wall (18*a*) that is articulated at (18*b*) relative to shaped, vertical projections (3*d*) on the external wall of the side. The lower part of small plate (18) extends as a spur (18*c*) that is substantially curved at an angle and protrudes inside the side through a window (3*c*). A spring (26) associated with the bolt (17) has one of its ends attached to the small retention plate (18).

Facing hook (21*a*) located on cheek (21) and coupled to the bent lever (14) is a fixed-position spur (27) joined to the vertical edge of said side (3) and having a recessed finger (27*a*) that defines a gap (i) and allows, during certain operating phases, movement and avoidance of the spur by the hook.

The swinging link (28) of supporting the service roll is provided in the subjacent part corresponding to the middle area (Z2). In particular, there is a part forming a swinging link (28) of substantially triangular shape of which the upper part (28*a*) is hinged on a pin (29) relative to side (3), said swinging link having an oblong opening (28*b*) allowing its removal from the side. On its base, said swinging link (28) is devised with a tab (30) hinged on a pin (31) located between projections (32) formed on the body of the swinging link. Said tab has, at one end, a cylindrical bump (30*a*) capable of projecting internally relative to the side and enabling the retention of a suspended reel of material. Said swinging link (28) is arranged obliquely and is held in position by means of a tension return spring (33) of which one end is joined to tab (30) and the other end is attached near the front part of the side to an anchoring point (34). The swinging link (28) is therefore maintained in the raised position by the effect of the return spring (33). A limit stop (35) formed on the side ensures that the swinging link is arrested in the raised position. In order to allow movement of cylindrical bump (30*a*) that retains the service roll, there is an essentially oblong, curved cutout (3*e*) in the side that corresponds to the swivelling movement of the swinging link, this cutout being preferably made as an extension to window (3*b*).

The components on the lateral side (4) will now be described. On this side (4) there are certain elements described previously, namely, on the upper part, the first mechanism with a flap that moves away when a roll of material is put in, this flap cooperating with a bent lever (14). The latter is also coupled to a swivelling cheek (21) of the above-mentioned type with an associated return spring. There is also a spur (27) attached to side (4), which has a finger (27*a*) around which the hook part (21*a*) of the cheek is capable of passing. There is also a swinging link (28) with associated small plate (30) that makes it possible to secure the service roll.

Side (4) is differently designed in that it is not required to include an additional means (18) of retaining the spare roll, the means located on side (3) being sufficient to ensure satisfactory operation of the assembly. Consequently, operation also does not involve any bolt (17). However, it is obvious, without going beyond the scope of the invention, that such features can be provided.

In contrast, the upper part of lateral side (4) is capable of accommodating a long arm (36) hinged on a pin (37) joined to the side. The back part of the arm (36*a*) has a cam shape on which a small bar (15) associated with the lever and flap rests. Displacement of the latter causes the arm to be lifted up and the end of the arm can advantageously accommodate a visual indicator (38) that is used to show whether or not a spare roll is fitted and waiting. In fact, a patch (39) that can be coloured is mounted on the end of this arm. This patch is capable of moving relative to a window provided in the part of the cover of the machine that faces it. When a spare roll is placed in the machine, the flaps are closed and the above-mentioned arm is raised so that the arm is not visible. When there is no spare roll, the flaps are located between the sides due to the relaxation of the elastic return means and the indicator part formed on the end of the arm is visible through the window made in the cover. The above provides a means of indicating that a spare roll is present.

The operation of the machine when a first service roll, then a spare roll are fitted will now be described. This fitting corresponds to the start of a machine utilisation cycle.

Before any roll of material is fitted, the mechanisms are located in the following positions due to the fact that the various springs are not loaded. Flaps (9) are in an extended position relative to the plane of lateral sides (3–4) so that levers (14) are in the raised position. The tab (18) formed on side (3) is then in a vertical position whereas its spur (18*c*) protrudes from side (3) and is hooked in bolt (17). Cheeks (21) formed on the two sides are raised in the upper position with their hook part (21*a*) in the up position relative to the fixed spur (27*a*). The lower shape (21*c*) of the cheeks projects inside the sides. The swinging links are in the up position whereas the tabs (30) allow the cylindrical bumps (30*a*) to protrude inside the space defined between the lateral sides (3–4).

The loading of a first reel of material which will become the service roll will now be described.

In the upper part of the machine, the operator places a first roll which, by penetrating between the lateral sides, causes flaps (9) to move away. By pivoting, these flaps ensure downward swivelling of the lever, release of the bolt (17) and lowering of the cheeks (21) associated with the lever. Through the downward swivelling action of the lever, its tip part (14*b*) lifts bolt (17) which releases the small plates (18)

that support the roll thus allowing downward movement of said roll. The tip part of the cheek is pushed away and moves downwards underneath fixed spur (27) on the side. Having been released, the first roll drops due to gravity and causes retraction of cheeks (21) in a lateral plane. The cheeks are retracted and swivelled relative to their hinge pin (22) so that end area **(21*b*) of the lower part of the cheeks pushes against tab (30) associated with the swinging link, thereby moving the cylindrical bump away from above-mentioned side. The upper part of the cheek forming a hook (21*a*) swivels so that it is substantially at the level of the gap formed on the fixed spur (27) of the limit stop. The roll drops, keeping cheeks (21) spread apart. Once the roll has dropped a certain distance, the roll escapes the pressure of flaps (9) and releases the latter. As a corollary to this, the flaps return to their previous position causing lifting of lever (14) and resetting of bolt (17) relative to small plate (18) of which the end once against protrudes into the internal plane formed between the sides. When the lever (14) is raised, associated cheeks (21) are themselves raised, thereby releasing tabs (30) causing the cylindrical bumps to be inserted into the hub of the roll. Because of its weight, the latter causes dropping of the swinging links in opposition to the spring elements (33) associated with the latter. Once the tabs are in position with a corresponding cylindrical bump, the machine can be put into service in the case of a single-roll version. The end strip of the reel is hanging down into the lower part of the machine near the mechanisms in the lower area (Z3)**, i.e. the drum and cutting device associated with the pressure component or other equivalent structure.

Having loaded the first roll, the operator then fits the spare roll (RR). In this phase the swinging link elements that support the first roll are lowered because of the weight of the first roll. In this phase, cheeks (21) are spread apart by the counterthrust of the lateral edges of the service roll of material. The parts forming a hook **(21*a*) located above fixed spurs (27) and bolt (17) ensure that the protruding part (18*c*) of the support tab (18) is locked in position. The profile (21*c*) of the cheek fulfills a braking function as the reel is unwound. Fitting the spare roll in the upper part will cause, as indicated previously, retraction of upper flaps (9). The retraction of the flaps (9) causes slight swivelling of the lever but the lever (14) is jammed in position because the hook part (21*a*) of the cheek presses against the projecting part (27*a*) of spur (27)**. Having completed loading, the operator (s) can unreel the service roll. Because the rolls weight gradually decreases, the swinging links have a tendency to rise, due to the effect of the return springs. This causes the swinging links to move closer towards the cheeks.

The reader is reminded that, during this period, said cheeks remain pressed against the edges of the reel. Due to the unreeling of the reel and subsequent reduction in its diameter, at a given time, parts **(21*c*) of the cheeks that are no longer in contact with the flanks of the reel but with its periphery escape inwards and towards the front. For several more turns, the cheeks remain pressed against the nearly exhausted reel with part (21*a*) which is no longer hooked in. When there are only a few remaining turns left to unreel, lever (14), having swivelled sufficiently, releases the bolt (17) by its tip (14*b*). Tab (18*a*) escapes and the spare roll can, in turn, drop into the lower part of the machine. During this movement, the flanks of the reel in turn cause spreading of the cheeks (21) which swivel again, thus causing the hook part (21*a*) to be positioned underneath spur (27). This retraction movement of the cheeks causes spreading of tabs (30) and the associated cylindrical bumps. This movement also causes release nearly exhausted service roll and the roll drops, due to gravity, into the rear part of the bottom of the machine. The slanting separating wall (8) for the cutting mechanisms then serves as a guide to cause evacuation of the reel towards the back where the reel can then be removed manually through the opening (1*e*)** in the housing.

Once the roll has been ejected, the spare roll takes up the position of the previous roll and releases the upper flaps (9). The upper flaps, as they return to their initial position, ensure lifting of the lever (14), swivelling of the cheeks and release of the tabs supporting the cylindrical bumps. Lifting of the cheeks (21) causes relocking of all the above mechanisms. The operator can then fit a new spare roll.

As indicated previously, a display means is used to check whether or not a spare roll is present.

The new machine described is especially advantageous for dispensing reels of material without end fittings. Sides (3–4) are provided, during manufacture, with all the moulded-on parts that are necessary for operation of the machine. Sides (3–4) are removable.

The lower part of the machine which was described briefly is devised to allow automatic or semi-automatic dispensing of strips of paper. The machine can be used to dispense hand wipe, general-purpose wipe, toilet paper and similar materials.

I claim:

1. A dispensing machine for automatically or semi-automatically dispensing strips of coiled paper, said machine being of the twin-roll type including a service roll and a spare roll each having a substantially hollow cylindrical central portion, said machine further comprising:

a housing having a protective cover;

a pair of spaced apart parallel lateral sides disposed within said housing, the spacing of said lateral sides defining an upper part sized to accommodate the spare roll, a middle part sized to accommodate the service roll, and a lower part sized to accommodate a drum, said machine including a cutting device and a pressure component that presses against the drum and between which a strip of paper to cut passes along a paper travel path;

each of said lateral sides further including:

clearance means for providing clearance for the service roll and the spare roll, first retaining means for retaining the spare roll, inwardly projecting tabs for retaining and supporting the service roll, each of said inwardly projecting tabs being sized for fitting inside of the cylindrical central portion of the service roll, monitoring means cooperating with said inwardly projecting tabs for monitoring the amount of paper dispensed from the service roll, releasing and transferring means for pulling said inwardly projecting tabs out from the inside of the cylindrical center portion of the service roll to enable said service roll to be removed from said middle part, for removing said first retaining means to allow the spare roll to fall from said upper portion into said middle portion, and for providing means for pushing said inwardly projecting tabs into the hollow central portion of said spare roll, and at least one shaped opening sized for clearance and articulation of at least one of said clearance means, said monitoring means, said first retaining means, said inwardly projecting tabs, and said releasing and transferring means.

2. A dispensing machine as claimed in claim 1, wherein said clearance means includes at least one hinged flap and flap biasing means for causing said at least one hinged flap to extend into the upper part between the lateral sides, wherein each of said inwardly projecting tabs are joined with swinging links for receiving and holding the service roll as it is being dispensed.

3. A dispensing machine as claimed in claim 1, wherein said clearance means includes at least one hinged flap that protrudes inside the lateral sides, said at least one hinged flap being capable of being retracted substantially into a first shaped opening formed in a corresponding lateral side when a service roll of paper is initially fitted in the machine, said at least one hinged flap including a protruding horizontal spur for connecting to a first return spring that acts relative to a fixed point on the lateral side.

4. A dispensing machine as claimed in claim 1, wherein each of said inwardly projecting tabs are joined with obliquely arranged swinging links on each corresponding lateral side, and wherein each of said swinging links and said inwardly tabs are biased by a second return spring, each of said lateral sides having a second shaped opening sized to provide clearance for said inwardly projecting tabs.

5. A dispensing machine as claimed in claim 2, wherein said first retaining means includes at least one retaining plate hinged with at least one lateral side, said at least one retaining plate having a spur capable of penetrating the thickness of said at least one lateral side through a third shaped opening thereof, said spur constituting a means of positioning and retaining the spare roll in said machine.

6. A dispensing machine as claimed in claim 5, wherein said releasing and transferring means includes at least one lever assembly including a bent lever, said bent lever having an upper part linked to said clearance, means, a portion of said upper part being shaped to cooperate with an articulated bolt, said articulated bolt cooperating with said first retaining means and in which, a lower part of said at least one lever assembly forms a leg capable of hingeably receiving said monitoring means, said monitoring means including a shaped cheek that monitors the diameter of the service roll during dispensing and further provides triggering for the release of said inwardly projecting tabs, thereby allowing for transferring of the spare roll.

7. A dispensing machine as claimed in claim 6, wherein a middle part of said bent lever is hinged to a lateral side, the upper part of said lever being joined with a connecting bar which is joined with a protruding horizontal spur of said at least one hinged flap, the upper part of said lever having means of rotating the articulated bolt for ensuring disengagement of the spare roll from said first retaining means.

8. A dispensing machine as claimed in claim 6, wherein the leg of said bent lever extends substantially horizontally along a lateral side and includes an end part which can be guided in a slit formed between said lateral side and a separately mounted tab, said leg further including support means for supporting a corresponding cheek.

9. A dispensing machine as claimed in claim 8, wherein said cheek is capable of hinging relative to said bent lever and can protrude by hinging through an appropriately sized fourth opening made in a corresponding lateral side, said cheek having an upper part forming a hook and a protruding lower part which faces the service roll in order to define a support and braking plane for said service roll, each said cheek further being capable of outwardly moving a corresponding inwardly projecting tab.

10. A dispensing machine as claimed in claim 9, including means for biasing said cheek, said cheek biasing means including a cheek return spring having one end attached to said cheek and having an opposite end connected with said corresponding lateral side.

11. A dispensing machine as claimed in claim 10, including a fixed-position spur disposed on a vertical edge of each lateral side, said spur having a recessed finger defining a gap that allows movement and avoidance of the fixed-position spur by the hook of said biased cheek during at least one operating phase of said machine.

12. A dispensing machine as claimed in claim 6, wherein said articulated bolt includes a back part having a ramp-like shape which cooperates with the upper part of said bent lever and a front part forming a hook which cooperates with said at least one retaining plate.

13. A dispensing machine as claimed in claim 4, wherein each of said swinging links is held in a first position by said second return springs, each said second return spring having a first end joined to one of said inwardly projecting tabs and a second end attached to a front part of a lateral side, wherein each lateral side includes a formed limit stop for ensuring the swinging link is stopped in a first raised position.

14. A dispensing machine as claimed in claim 7, wherein a portion of said bent lever includes an indicator means for indicating that the spare roll is present in the machine.

15. A dispensing machine as claimed in claim 1, including a profiled plate disposed in a lower part of said machine for protecting the drum, pressure component and cutting device of the machine, said profiled plate having an inclined upper portion which allows evacuation of an exhausted service roll towards the back of the machine.

* * * * *